United States Patent [19]

Rau, III

[11] 4,355,830

[45] Oct. 26, 1982

[54] ELECTRICAL LOCKING MECHANISM

[75] Inventor: David M. Rau, III, Lincoln, Nebr.

[73] Assignee: CNI Incorporated, Lincoln, Nebr.

[21] Appl. No.: 124,525

[22] Filed: Feb. 25, 1980

[51] Int. Cl.[3] ..... E05C 1/14

[52] U.S. Cl. ..... 292/144; 292/254; 292/341.17

[58] Field of Search ..... 292/144, 341.17, 254, 292/177, 181, 341.16, DIG. 44, 181, 179

[56] References Cited

U.S. PATENT DOCUMENTS

| | | | |
|---|---|---|---|
| 229,995 | 7/1880 | Freeman | 292/254 X |
| 567,156 | 9/1896 | Nash | 292/144 |
| 792,404 | 6/1905 | Dean . | |
| 1,048,060 | 12/1912 | Foss | 292/181 |
| 1,185,422 | 5/1916 | Mammelli | 292/254 X |
| 1,185,644 | 6/1916 | Farrington | 292/181 |
| 1,394,635 | 10/1921 | Maturo | 292/181 |
| 2,575,465 | 11/1951 | Patton | 292/341.17 X |
| 2,786,701 | 3/1957 | Povlich | 292/341.16 X |
| 3,100,389 | 8/1963 | Noregaard | 70/278 |
| 3,266,668 | 8/1966 | Davis | 292/181 X |
| 3,338,612 | 8/1967 | Howard | 292/DIG. 44 |
| 3,576,119 | 4/1971 | Harris | 292/179 X |
| 3,641,396 | 2/1972 | Kossen et al. | 317/134 |
| 3,710,136 | 1/1973 | Constable et al. | 307/109 |
| 3,751,718 | 8/1973 | Hanchett, Jr. | 317/134 |
| 3,758,142 | 9/1973 | Gartner | 292/254 |
| 3,764,859 | 10/1973 | Wood et al. | 317/134 |
| 3,792,888 | 2/1974 | Kambic | 292/173 |
| 3,819,215 | 6/1974 | Fuss | 292/341.16 X |
| 3,845,362 | 10/1974 | Roe | 317/134 |
| 3,854,120 | 12/1974 | Matto et al. | 340/164 |
| 3,872,696 | 3/1975 | Geringer | 292/254 |
| 3,893,723 | 7/1975 | Boule | 292/140 |
| 3,897,093 | 7/1975 | Wicyer et al. | 292/144 |
| 4,013,930 | 3/1977 | Geller | 361/172 |
| 4,021,065 | 5/1977 | Gerwiger | 292/144 |
| 4,051,548 | 9/1977 | Hamada | 361/171 |
| 4,102,213 | 7/1978 | Smith | 74/110 |
| 4,132,439 | 1/1979 | Millor | 292/144 |

FOREIGN PATENT DOCUMENTS

| | | | |
|---|---|---|---|
| Ad.14066 | 5/1891 | United Kingdom | 292/181 |
| 14310 | of 1895 | United Kingdom | 292/179 |

*Primary Examiner*—Richard E. Moore

*Attorney, Agent, or Firm*—Hosier, Niro & Daleiden, Ltd.

[57] ABSTRACT

An electrically actuated locking mechanism is disclosed which employs a reciprocating lock bolt actuated by a solenoid in response to a momentary electrical signal. The lock bolt engages a latch means when extended to the locking position, and the latch means may be disengaged to unlock the device by either electrically or mechanically actuated release means.

12 Claims, 7 Drawing Figures

ELECTRICAL LOCKING MECHANISM

DESCRIPTION

Background of the Invention

The present invention relates generally to locking devices and, more particularly, to electrically actuated mechanisms for locking a door, window or other passage-closing structure in the closed position.

In recent years a significant demand has developed for electrically operable door locks and latching mechanisms. These electrical locking devices facilitate the utilization of remote control security systems which, in turn, help to reduce the manpower and costs attendant to maintaining restricted access areas. Because of this demand, a number of electrically actuated locking mechanisms have been developed, several of which are disclosed in U.S. Pat. Nos. 3,792,888; 3,893,723, 3,897,093; 4,021,065; 4,102,213 and 4,132,439. While such prior art devices have met with some success, they nevertheless suffer from several disadvantages which have limited their utility, practical application and, ultimately, their commercial acceptance. For example, some prior art devices require continuous electrical power to maintain the locking function. This not only increases energy consumption, but may also result in failure of the security system upon a loss of power. Another disadvantage of known prior art devices is that the travel or extension of the lock bolt is limited, with the result that even a small separation of the door and adjacent door jamb will free the door from the lock bolt thereby defeating the locking device. Finally, the great majority of prior art electrical locking mechanisms embody a complex assembly of several components which not only increases manufacturing costs but also raises the incidence of malfunction and the need for more frequent maintenance and repair.

SUMMARY OF THE INVENTION

Accordingly, the present invention is directed to an electrically actuated locking mechanism of unique construction which overcomes the known disadvantages of prior art locking devices. The locking mechanism of the present invention requires only a momentary electrical signal or electrical pulse to initiate the locking and release functions, and will remain locked even if the electrical service to the security systems fails. Moreover, the mechanism employs a floating lock bolt which effectively prevents unauthorized override of the lock by separation of the door and door jamb. In accordance with a preferred embodiment of the invention, the locking mechanism includes both electrical and mechanical release means permitting authorized unlocking of the mechanism via an electrical security system or manually from within the restricted access area. Finally, the locking mechanism of the present invention incorporates a relatively simple design with relatively few individual components, making the device more reliable in service and less costly to manufacture.

In accord with one embodiment of the invention, the locking mechanism includes a lock bolt which is reciprocally movable between a retracted, non-locking position and an extended, locking position. The lock bolt is urged toward the retracted position by a biasing means, and is moved in opposition to the action of the biasing means to the extended position by an actuating means which operates in response to a momentary electrical signal. A latch means mechanically retains the lock bolt in the extended position and is disengaged from the lock bolt by a release means which also operates in response to a momentary electrical signal. The lock bolt is mounted to move freely or "float" in relation to the actuating means so that engagement with the latch means is maintained and the locking function is not defeated by separation of the door and door jamb.

An important object, therefore, of the present invention is the provision of an electrically actuated locking mechanism which utilizes only momentary electrical signals to actuate the locking and unlocking functions and does not require continuous power to remain locked.

Another object of the invention is the provision of an electrically actuated locking mechanism and a simple and fail-safe manual override device accessible from within the restricted access area.

Still another object of the invention is the provision of an electrically actuated locking mechanism more difficult to defeat than prior art locking devices.

And yet another object of the invention is the provision of an electrically actuated locking mechanism wherein the electrically actuated release means includes a displacement element which makes direct and positive contact with the latch means to assure disengagement of the latch means and unlock the mechanism.

BRIEF DESCRIPTION OF THE DRAWINGS

The novel features which are believed to be characteristic of the invention are set forth in the appended claims. The invention itself, however, together with further objects and attendant advantages thereof, will be best understood by reference to the following description taken in connection with the accompanying drawings in which:

DETAILED DESCRIPTION OF THE PREFERRED EMBODIMENTS

Figure 1:
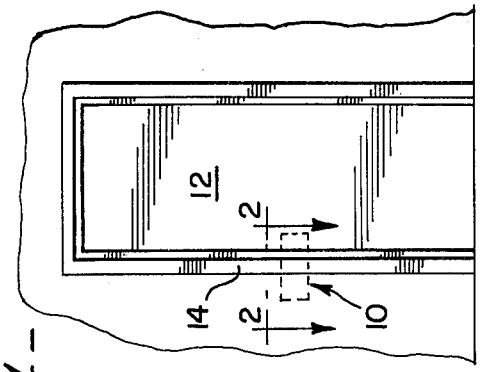
FIG. 1 is a side elevational view illustrating a conventional wall, door frame and door and depicting placement of the locking mechanism of the present invention.

Referring now to FIG. 1, the locking mechanism of the present invention 10 is shown mounted in a conventional door 12 and door jamb 14. Those skilled in the art will recognize, of course, that locking mechanism 10 may be employed with a wide variety of passage-closing structures (windows, gates, etc.) and that the description of the invention made in this specification is for purposes of illustration and is not intended to limit the invention to doors or any specific type or class of passage-closing structure.

Figure 2:
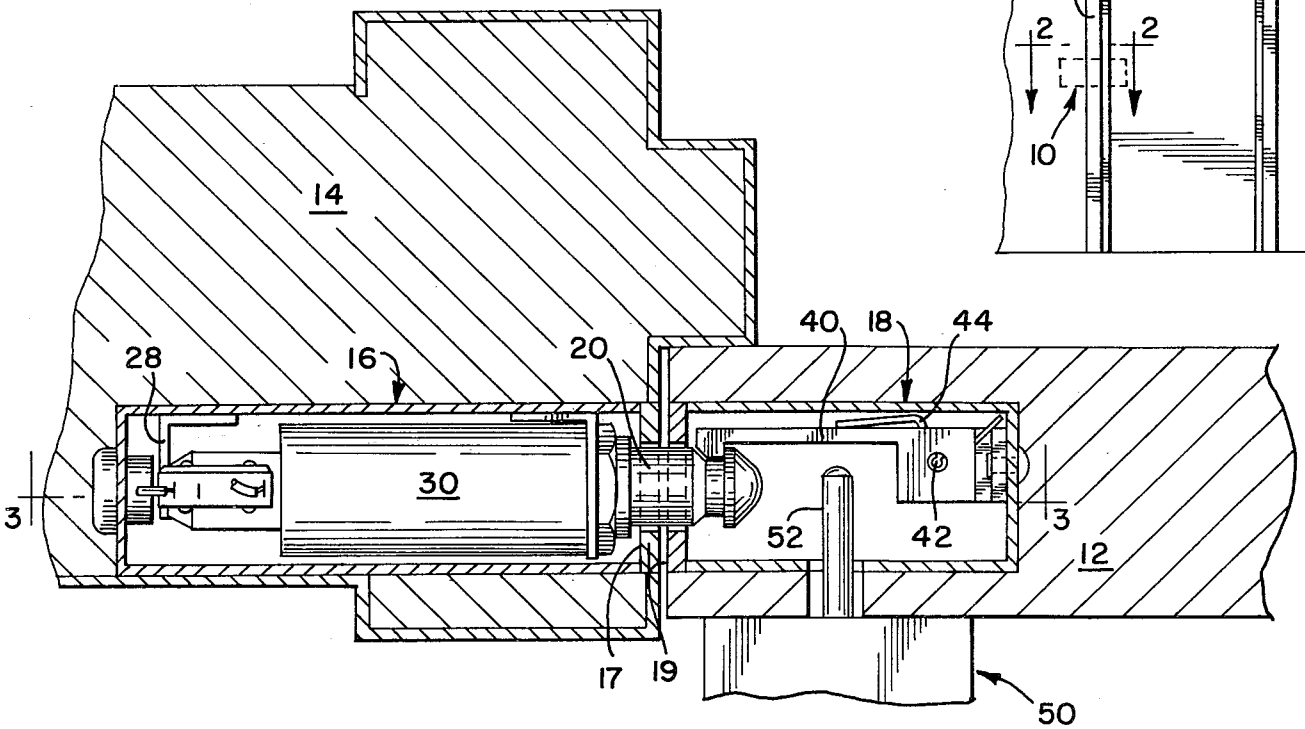
FIG. 2 is an enlarged cross-sectional view taken along line 2—2 of FIG. 1, showing the locking mechanism of the present as mounted in the door and door jamb and in the locked position.
Figure 3:
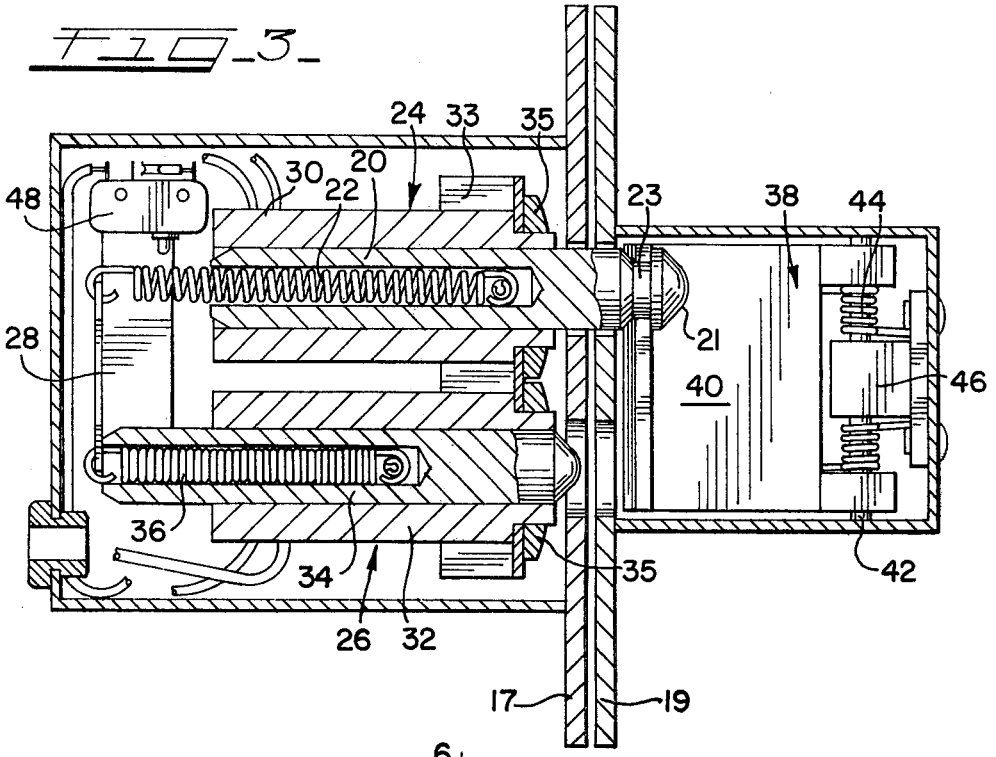
FIG. 3 is a cross-sectional view taken along line 3—3 of FIG. 2.

As shown in detail in FIGS. 2 and 3, locking mechanism 10 comprises two subassemblies, 16 and 18 respectively, with the first subassembly 16 mounted in the door jamb 14 and the second subassembly mounted in the door 12. Once again, the placement of the subassemblies as shown is simply for purposes of illustration. Their placement may optionally be reversed with the first subassembly mounted in the door and the second subassembly mounted in the door jamb. In any event, the subassemblies are mounted in the door and door jamb with their respective face plates 17 and 19 in juxtoposition.

The first subassembly 16 includes a lock bolt 20, biasing means or extension spring 22, actuating means 24 and release means 26. The lock bolt 20 is mounted for reciprocal movement between a retracted, non-locking position and is urged toward the retracted position by spring 22 which is anchored to flange 28. Lock bolt 20 is provided with a conical extremity 21 and a retaining element or annular recess 23 adjacent extremity 21. The actuating means 24 comprises a solenoid 30 which drives the lock bolt 20 to the extended position against the action of the spring 22. In accordance with the present invention, the solenoid, lock bolt and spring are matched such that only a momentary electrical signal (i.e., ordinarily only a few milliseconds of electrical power to the solenoid) is required to move the lock bolt to the fully extended position. The release means 26 comprises a solenoid 32, a plunger or displacement member 34 and a biasing means or extension spring 36 also anchored to flange 28. Both solenoids 30 and 32 may be mounted to a flange 33 in a conventional fashion such as with threaded nuts 35. The operation of the release means 26 will be described in detail below.

The second subassembly 18 includes a latch means 38 which retains the lock bolt 20 in the extended position. When retained in this fashion, lock bolt 20 serves to lock the door 12 in the closed position in the same manner as the conventional dead bolt. The latch means 38 comprises a detent 40 rotatably mounted on pivot pin 42 and biased toward a lock bolt-engaging position by a torsion spring 44. The pivot pin 42 is mounted within journal block 46 which in turn is supported in conventional fashion to the housing of subassembly 18. As shown in FIGS. 2 and 3, when the lock bolt 20 reaches its extended position, the detent 40 mates with annular recess 23 thereby retaining the lock bolt in its extended position against the action of spring 22.

Figure 5:
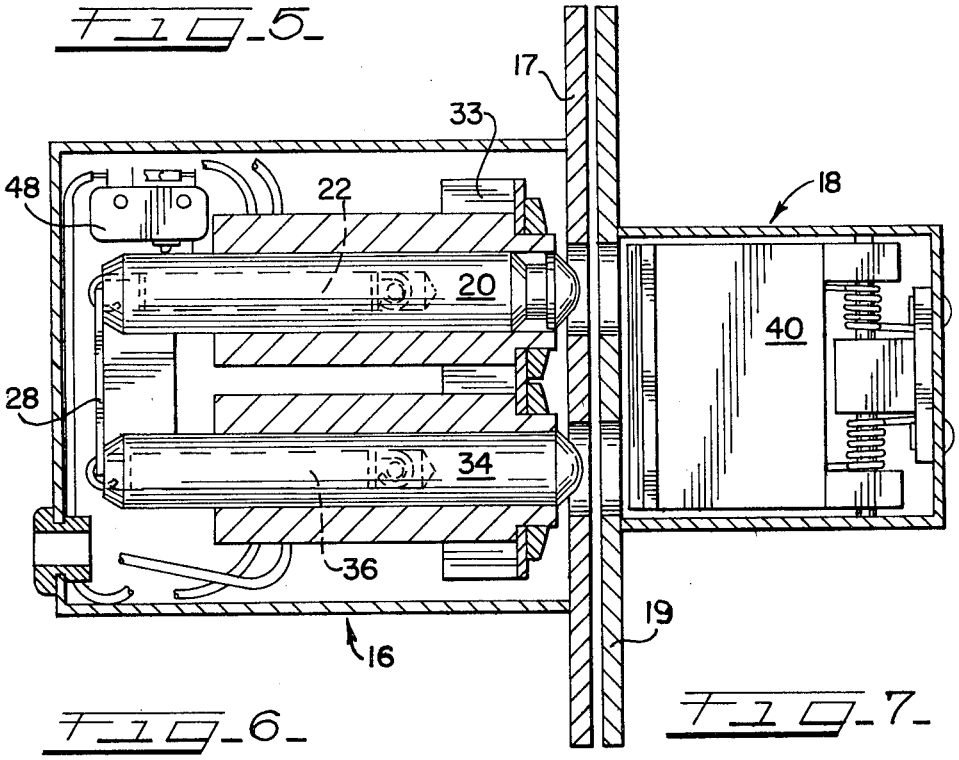
FIG. 5 is a cross-sectional view similar to those of FIGS. 3 and 4, but showing the locking mechanism in the unlocked position.

As shown in FIGS. 3 and 5, a switching means such as microswitch 48 may be mounted in subassembly 16 and positioned to cooperate with the base of lock bolt 20 when the lock bolt is in its retracted position. The function and operation of switch 48 will be described in greater detail below.

Figure 6:
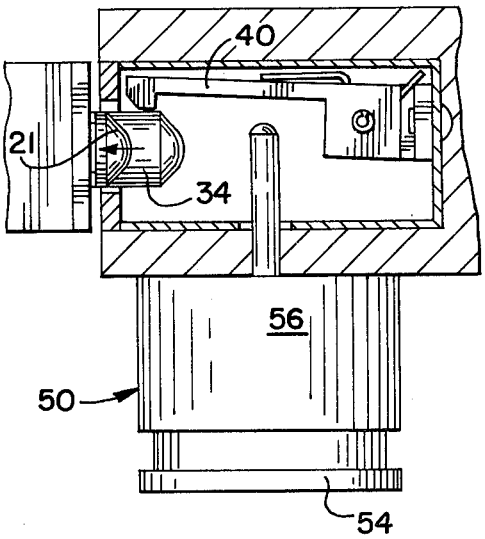
FIG. 6 is a cross-sectional view taken along line 6—6 of FIG. 4, showing the electrically actuated release in operation.
Figure 7:
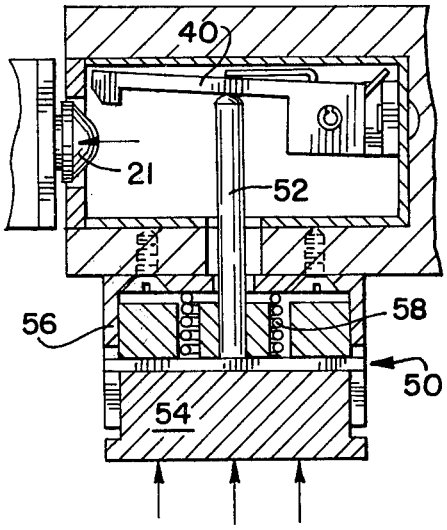
FIG. 7 is a cross-sectional view similar to that of FIG. 6, but showing the manually actuated release in operation.

In accordance with the present invention, the electrically actuated locking mechanism preferrably includes a mechanical release means which permits manual release of the locking mechanism from within the restricted access area. Mechanical release means 50 is illustrated in FIGS. 2, 6 and 7 and comprises a plunger 52 mounted to a base 54. The base 54 is supported by housing 56 and can reciprocate within the housing. The plunger 52 and base 54 are biased by compression spring 58 away from detent 40. The base 54, however, may be manually depressed (as shown in FIG. 7) whereby plunger 52 will disengage the detent 40 from lock bolt 20.

Figure 4:
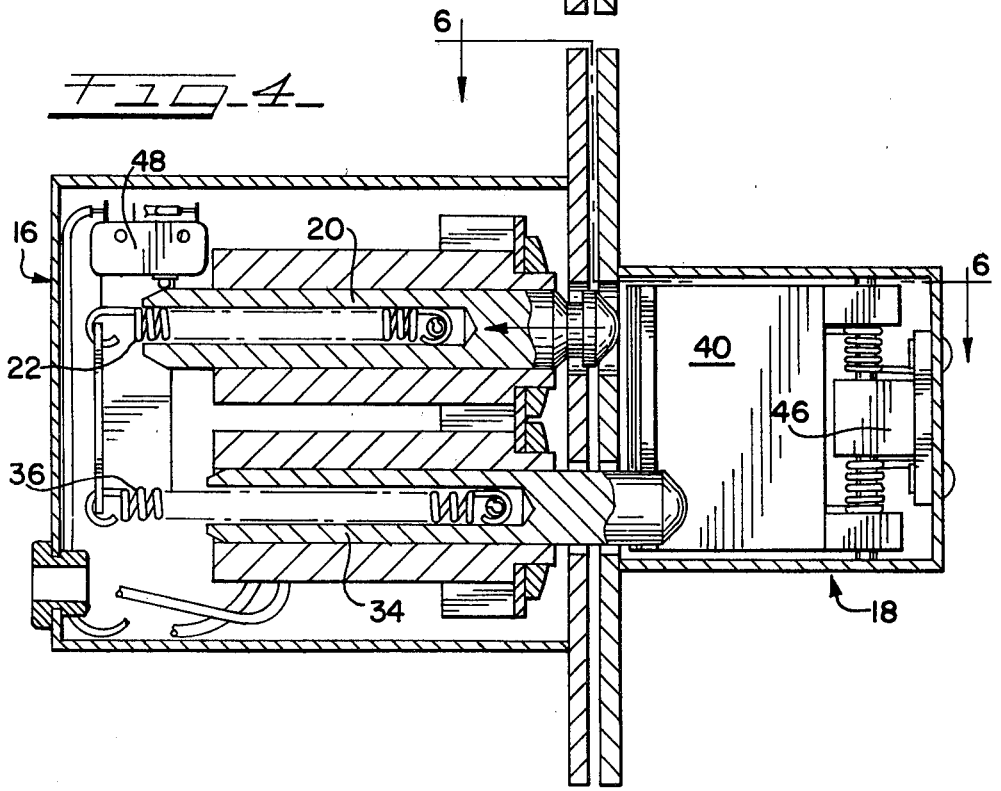
FIG. 4 is a cross-sectional view similar to that of FIG. 3, but showing the locking mechanism of the present invention as the lock bolt is releasing from the locked position in response to an electrical release signal.

The locking mechanism of the present invention operates simply and effectively to provide a positive, dead bolt lock and both an electrical and mechanical release. The locking mechanism 10 is shown in the unlocked position in FIG. 5 with the dead bolt 20 and displacement member 34 both fully retracted under the force of springs 22 and 36, respectively. When in the retracted position dead bolt 20 engages microswitch 48 so that the security system read out equipment indicates the locking mechanism is in the unlocked state. When an electrical signal is directed to the locking mechanism, solenoid 30 is actuated driving dead bolt 20 to the extended position. As dead bolt 20 moves to the extended position, its conical extremity 21 passes the detent 40 which then mates with the annular recess 23 and, under the force of spring 44, retains the dead bolt in the extended, locking position. When extended lock bolt 20 is spaced from microswitch 48, the security system read out equipment will indicate that the locking mechanism is in the locked position. A subsequent "release" signal to the locking mechanism will activate solenoid 32, driving displacement member 34 into subassembly 18 as shown in FIGS. 4 and 6. The displacement member 34 engages and rotates detent 40 about its pivot pin 42, thereby disengaging the detent from dead bolt 20 which retracts into subassembly 16 under the action of spring 22. Likewise, when power to displacement member 34 is terminated it retracts into subassembly 16, leaving the locking mechanism as shown in FIG. 5. Alternatively, the detent 40 may be manually disengaged by depressing the mechanical release means 50 so that plunger 52 engages and rotates the detent 40 about its pivot pin. Using either the electrical or mechanical release means, once the release function is complete the detent 40 is immediately repositioned for engagement with lock bolt 20.

Those skilled in the art will recognize from the foregoing description the several advantages attendant to the present invention. Both subassemblies 16 and 18 may be constructed as relatively small components to facilitate their mounting in conventional doors, door jambs and other building structures. For example, the use of coaxial and telescopically assembled springs with both the lock bolt 20 and displacement member 34 helps to reduce size. Likewise, employment of the lock bolt and displacement member as the solenoid plungers also minimuizes parts and space requirements. It will also be apparent that the construction of a locking mechanism in accord with the teachings of the present invention should prevent unauthorized disengagement of the lock by the common practice of separating the door and door jamb with a jack or other device. Because the lock bolt 20 is mechanically retained within the door and is free to move with the door, the door and door jamb would have to be separated by a distance almost the entire length of the lock bolt which would, in most instances, be quite difficult if not impossible. Finally, both the electrical and mechanical release means employ a mechanical displacement device which positively engages and displaces the latch means to unlock the device. Both operate in a simple and expedient manner to insure release of the lock bolt.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. An electrically actuated mechanism for loading a door or other passage-closing structure in the closed position relative to a stationary member, comprising:

a lock bolt reciprocally mounted on one of said passage-closing structure or said stationary member and movable between a retracted, non-locking position and an extended, locking position;

biasing means mounted on said one passage-closing structure or said stationary member for mechanically urging said lock bolt toward said retracted position;

actuating means mounted on said one passage-closing structure or said stationary member and responsive to a momentary electrical signal for moving said lock bolt in opposition to said biasing means from said retracted position to said extended position;

mechanical latch means mounted on the other of said passage-closing structure or said stationary member for retaining said lock bolt in said extended position notwithstanding cessation of said momentary electrical signal to said actuating means; and release means mounted on said one passage-closing structure or said stationary member and responsive to a momentary electrical signal for mechanically displacing said latch means and disengaging said latch means from said lock bolt to permit said biasing means to move said lock bolt from said extended position to said retracted position independently of any said electrical signals.

2. The locking mechanism of claim 1 wherein said biasing means comprises a spring telescopically mounted within said lock bolt.

3. The locking mechanism of claim 1 wherein said actuating means comprises a solenoid and said lock bolt is mounted within the solenoid and serves as the solenoid plunger.

4. The locking mechanism of claim 1 wherein said lock bolt includes a retaining element and said latch means includes a spring biased detent, said detent engaging said retaining element when said lock bolt moves to the extended position.

5. The locking mechanism of claim 4 wherein said retaining element comprises an annular recess adjacent the distal extremity of said lock bolt.

6. The locking mechanism of claim 1 wherein said release means comprises a solenoid having a plunger which mechanically disengages said latch means from said lock bolt when actuated by said electrical signal.

7. The locking mechanism of claim 6 wherein said plunger is mechanically biased toward a position remote from said latch means.

8. The locking mechanism of claim 1 further including mechanical release means for manually disengaging said latch means.

9. An electrically actuated mechanism for locking a passage-closing structure in the closed position relative to a stationary member, comprising:

a lock bolt reciprocally mounted on one of said passage-closing structure or said stationary member and movable between a retracted, non-locking position and an extended, locking position;

biasing means mounted on said one passage-closing structure or said stationary member and disposed coaxially with said lock bolt for mechanically urging said lock bolt toward said retracted position;

actuating means mounted on said one passage-closing structure or said stationary member and responsive to a momentary electrical signal for moving said lock bolt in opposition to the action of said biasing means from said retracted position to said extended position;

latch means mounted on the other of said passage-closing structure or said stationary member for retaining said lock bolt in said extended position notwithstanding cessation of said momentary electrical signal to said actuating means;

electrical release means mounted on said one passage-closing structure or said stationary member responsive to a momentary electrical signal for disengaging said latch means from said lock bolt to permit said biasing means to move said lock bolt from said extended position to said retracted position, said release means including a displacement member which makes mechanical and direct contact with said latch means to displace said latch means from engagement with said lock bolt independently of any said electrical signals; and mechanical release means for manually disengaging said latch means from said lock bolt.

10. An electrically actuated mechanism for locking a movable, passage-closing structure in the closed position within a stationary wall member to restrict access to an area bounded at least in part by said wall member, said mechanism comprising:

a first subassembly including a lock bolt, biasing means, actuating means and release means all mounted on either one of said passage-closing structure or said wall member, and a second subassembly including a latch means mounted on the other of said passage-closing structure or said wall member;

said lock bolt being reciprocally movable between a retracted position within said first subassembly and an extended position within said second subassembly;

said biasing means being coupled to said lock bolt within said first subassembly to mechanically urge said lock bolt toward the retracted position;

said actuating means of said first subassembly being responsive to an electrical signal to move said lock bolt from said retracted position to said extended position;

said latch means being within said second subassembly and retaining said lock bolt in the extended position within said second subassembly; and said release means of said first subassembly being responsive to an electrical signal to disengage said latch means within said second subassembly from said lock bolt to permit said biasing means to move said lock bolt from said extended position within said second subassembly to said retracted position within said first subassembly.

11. The locking mechanism of claim 10 further including a mechanical release means accessible from within said bounded area for manually disengaging said latch means.

12. The locking mechanism of claim 11 wherein said lock bolt floats within said first subassembly and will remain retained within said second subassembly as said subassemblies are separated along the longitudinal axis of said lock bolt.

* * * * *